US006599592B1

(12) United States Patent
Schulz

(10) Patent No.: US 6,599,592 B1
(45) Date of Patent: Jul. 29, 2003

(54) RECORDING MATERIAL FOR THE INK JET PRINTING METHOD

(75) Inventor: Hartmut Schulz, Wallenhorst (DE)

(73) Assignee: Felix Schoeller jr. Foto-und Spezialpapiere GmbH & Co. KG (DE)

( * ) Notice: Subject to any disclaimer, the term of this patent is extended or adjusted under 35 U.S.C. 154(b) by 77 days.

(21) Appl. No.: 09/712,361

(22) Filed: Nov. 14, 2000

(30) Foreign Application Priority Data

Nov. 15, 1999 (DE) ..... 199 55 081

(51) Int. Cl.[7] ..... B41M 5/00
(52) U.S. Cl. ..... 428/32.18
(58) Field of Search ..... 428/195, 32.18; 347/105; 427/146, 152

(56) References Cited

U.S. PATENT DOCUMENTS 4,044,185 A * 8/1977 McCaskey et al. ..... 428/153
4,124,439 A 11/1978 Dessauer
4,308,542 A * 12/1981 Maekawa et al. ..... 346/1.1
4,895,759 A * 1/1990 Crawford ..... 428/331
6,087,051 A * 7/2000 Shoji et al. ..... 430/14
6,221,546 B1 * 4/2001 Yau et al. ..... 430/14

FOREIGN PATENT DOCUMENTS

| | | |
|---|---|---|
| DE | 43 07 241 C2 | 9/1994 |
| DE | 196 05 970 A1 | 7/1997 |
| EP | 0 600 245 A1 | 6/1994 |
| EP | 0 938 980 A2 | 9/1999 |
| GB | 1 477 853 | 6/1977 |

OTHER PUBLICATIONS

Wochenblatt für Papierfabrikation 18–1997, pp 878–883.

* cited by examiner

*Primary Examiner*—Bruce H. Hess
(74) *Attorney, Agent, or Firm*—Cook, Alex, McFarron, Manzo, Cummings & Mehler, Ltd.

(57) ABSTRACT

A recording material for the ink jet printing method comprising a base paper which contains 5 to 55% by weight of a filler, is free of beater sizing agents, and is impregnated with an impregnation agent, wherein the resin uptake from the impregnation agent is adjusted such that the base paper on the backside has a liquid uptake of at most 20 g/m$^2$, and optionally further layers.

9 Claims, No Drawings

RECORDING MATERIAL FOR THE INK JET PRINTING METHOD

BACKGROUND OF THE INVENTION

The invention relates to an ink jet recording material with a base paper which is new for this purpose.

In the ink jet recording method tiny ink droplets are applied onto a recording material with the aid of different techniques, which have been already described several times, and received by the recording material.

Different requirements are placed on the recording material such as high color density of the printed dots, a fast ink reception and a sufficient wiping fastness connected therewith, a dye diffusion in the transverse direction of the printed dots which does not surpass the required degree as well as minimal mottle and a high water fastness.

Ink jet recording materials are comprised of a carrier material, an ink receiving layer applied thereto, and optionally further auxiliary layers.

Ink jet printers for producing photo-like prints use ink with a high proportion of water as a solvent. When using conventional ink jet papers, a wavy appearance in the transverse direction (cockle) occurs due to the high water content which penetrates through the ink receiving layer into the paper support. This wavy appearance results in a contact of the recording material with the print head and has the consequence of a deterioration of the printed image. Moreover, the head contact can result in damage of the receiving material. It is therefore required to employ for producing photo-like ink jet prints a recording material in which the base paper has a high dimensional stability and is thus able to receive a large water quantity without exhibiting the aforementioned wavy appearance.

From JP 06-262845 A a receiving material is known whose paper carrier contains hardwood pulp and has a sizing of starch and alkyl ketene dimer. The claimed paper is said to have a good absorption capability and uniform appearance of the printed dots. However, a disadvantage of this receiving material is the insufficient dimensional stability (wavy appearance) at high water uptake.

The same problem of insufficient dimensional stability at high water uptake is also observed in a recording paper described in JP 08-258399 A which contains a calcium carbonate with spindle-shaped particles and neutral sizing agents.

The cockle problem is to be solved according to JP 11-099737 by an ink jet paper which, in addition to an ink receiving layer, has at least one further so-called carrier layer which is comprised of a water-insoluble resin such as polyethylene or polypropylene. A disadvantage is the long drying time of the printed recording paper.

SUMMARY OF THE INVENTION

It is an object of the invention to provide a recording material for the ink jet printing method which exhibits a good dimensional stability and high water uptake capability and, moreover, in addition to a high color density, exhibits excellent wiping fastness and good water fastness.

This object is solved by a base paper which is free of a beater sizing agent, contains 5 to 55% by weight of a filler, and is impregnated with an impregnation resin, wherein the resin uptake is adjusted such that the base paper at the backside has a liquid uptake of at most 20 g/m$^2$, preferably 3 to 6 g/m$^2$. The backside of the base paper is the side opposite the image-carrying side.

The subject matter of the invention is moreover an ink jet recording material with the aforedescribed base paper as a support and at least one ink receiving layer arranged on the front side. Between the support and the ink receiving layer, and on the ink receiving layer, further layers can be arranged.

DETAILED DESCRIPTION OF THE PREFERRED EMBODIMENTS

The filler contained in the raw paper can be titanium dioxide, zinc sulfide, calcium carbonate, kaolin, talc, clay, or mixtures of these fillers. In a preferred embodiment, a mixture of titanium dioxide and kaolin in a mixing ratio (weight) of 1:10 to 10:1 is used. Especially good results are obtained for a mixing ratio of 1:1. The filler proportion is 5 to 55% by weight, preferably 20 or 25 to 50% by weight based on the weight of the raw paper.

For producing the base paper according to the invention, softwood pulp (long fiber pulp) or hardwood pulp (short fiber pulp) can be used. Preferred is a pulp or pulp mixture with a specific volume of 1.4 to 2.0 cm$^3$/g, in particular, 1.4 to 1.6 cm$^3$/g (for a freeness value of 20 to 35° SR). The fiber length after beating should be preferably 0.6 to 1.2 mm. According to a preferred embodiment of the invention, a eucalyptus pulp or a mixture of eucalyptus and softwood pulp is used.

Wet strength agents such as polyamide/polyamine-epichlorohydrin resin, retention agents such as quaternary polyammonium salts, defoaming agents, penetration accelerators such as saccharides, and other additives can be added to the pulp suspension. In comparison to conventional base papers for ink jet recording materials, the raw papers according to the invention have no sizing agents which are conventionally used in beater sizing.

According to one embodiment of the invention, the recording material contains a so-called one-sided smooth raw paper. The raw paper smooth on one side is preferably produced on a Yankee machine wherein the Fourdrinier wire side of the paper web is smoothed with the aid of a heated cylinder. Because of the long contact time of the paper with the cylinder, a closed surface can be generated whose smoothness should not fall below 1000 ml/sec, measured according to Bendtson.

In further embodiments of the invention, it is also possible to employ a raw paper open on both sides, i.e., not smoothed, which can then be smoothed in a calender after impregnation on one side or both sides.

The resin is an impregnation resin that is conventionally employed in the paper industry. It can be selected from the group of diallyl phthalates, epoxide resins, urea formaldehyde resins, urea-acrylic acid ester copolyesters, melamine formaldehyde resins, melamine phenol formaldehyde resins, phenol formaldehyde resins, poly(meth)acrylates or unsaturated polyester resins. In a special embodiment of the invention, the coating mass contains a mixture of an acrylic acid ester and urea formaldehyde resin. Especially good results can be obtained with a mixing ratio (weight) of acrylic acid ester/urea formaldehyde resin of 1:10 to 10:1.

The impregnation with the resin can be performed in-line in the paper machine in a sizing box or off-line external to the paper machine in a size press or in an impregnation device. The raw paper can be impregnated from the front side or from the backside or from both sides, wherein the resin penetrates into the interior of the raw paper. The resin uptake of the paper is adjusted such that the impregnated raw paper has at the backside a liquid uptake of at most 20 g/m$^2$, preferably 3 to 6 g/m$^2$. The amount of resin (coating mass) can be 2 to 25 g/m$^2$, preferably 5 to 8 g/m$^2$.

Basically any desired ink receiving layer can be applied onto the base paper according to the invention. These are usually hydrophilic coatings which contain water-soluble or water-dispersible polymers, for example, polyvinyl alcohol, cationic polyvinyl alcohol, polyvinyl pyrrolidone, polyvinyl acetate, starch, gelatin, casein, or carboxymethyl cellulose. The ink receiving layer can contain additionally pigments and cationic substances for fixation of the ink dyes.

In a particularly preferred embodiment of the invention, the ink receiving layer comprises a polyvinyl alcohol or a mixture of polyvinyl alcohol and an acrylic acid ester homopolymer and/or copolymer. In another embodiment of the invention the ink receiving layer may contain a cationic dye fixing agent and a pigment. The application weight of the ink receiving layer is 2 to 20 g/m$^2$, in particular 6 to 15 g/m$^2$. The ink receiving layer can be applied with conventional application methods such as roller coating, gravure coating, or nip methods and air brush or roll doctor metering.

In a special embodiment of the invention the recording paper may comprise an additional polymer layer arranged on the receiving layer. The polymer contained in this layer has a Shore hardness (D)>50 (ASTM D 2240). Especially suitable is an acrylic acid ester homopolymer and/or copolymer. The application weight of the layer is 1 to 10 g/m$^2$, in particular 2 to 6 g/m$^2$.

The invention will be explained in more detail with the following examples.

EXAMPLES 1 to 3

A mixture of 90% by weight hardwood sulfate pulp and 10 by weight softwood sulfate pulp was beaten at a material density of 4% up to a freeness value of 42° SR.

Subsequently, 5% by weight polyamide/polyamine-epichlorohydrin resin and 25% by weight of a pigment mixture of titanium dioxide (rutile form) and kaolin in a mixing ratio of 1:1 were added. The weight data of the additives are based on the pulp.

From this mixture a raw paper with a weight of 100 g/m$^2$ and a thickness of 120 im was produced. The paper having an air permeability of 8 Gurley seconds per 100 ml was impregnated with the following impregnation agent:

Acrylate/styrene copolymer (47% aqueous dispersion)

(Primal® E-2556) 33% by weight

Urea-formaldehyde (50% aqueous solution)

(Urecoll® TS) 33% by weight

Defoaming agent (OEKOFOAM®-E 190) 1% by weight

Water 33% by weight

The impregnation was carried out in the paper machine with the aid of a sizing box. The coating weights are listed in Table 1 and are based on the dried mass. Also shown in Table 1 is the liquid uptake on the backside of the impregnated base paper measured according to DIN 53132.

TABLE 1

| Example | Coating Weight, g/m$^2$ | Liquid Uptake, g/m$^2$ |
|---|---|---|
| E1 | 8 | 4 |
| E2 | 12 | 3 |
| E3 | 18 | 4 |

The base papers produced according to the examples were coated with an ink receiving layer of the following composition:

| | |
|---|---|
| Polyvinyl alcohol, 20% aqueous solution (Mowiol ® 20–98) | 760 g |
| Styrene copolymer, 20% dispersion (Basoplast ® 265 D) | 170 g |
| Butanol | 70 g |

The coating of the papers was carried out by means of doctor blade metering. The coating weight of the ink receiving layer was 10 g/m$^2$ for all papers.

In all further working steps the papers provided with the ink receiving layer were coated with a coat of lacquer of the following composition in an amount of 3 g/m$^2$, based on the weight of the dried layer:

| | |
|---|---|
| n-butyl acrylate/styrene-copolymer (50% aqueous dispersion-Acronal ® S 305 D) | 95% by weight |
| cross-linking agent | 5% by weight |

Comparative Example C1

The raw paper produced according to example 1 was coated, without impregnation with the coating mass, with the ink receiving layer of example 1 according to the invention.

Comparative Example C2

A raw paper with a weight of 100 g/m$^2$ was produced of a pulp suspension with hardwood pulp, 25% by weight calcium carbonate, 0.8% by weight cationic starch, and 0.5% by weight alkyl ketene dimer (quantities relative to the mass of the pulp). Subsequently, the raw paper was surface-sized with starch and provided with an ink receiving layer, comprised of 80% by weight silicic acid and 20% by weight polyvinyl alcohol.

Examination of the Recording Papers Produced According to Examples 1 to 3 and Comparative Examples C1 to C2

The recording paper according to the invention was printed with an ink jet printer HP DeskJet® 550C of the Hewlett-Packard corporation. The cockle behavior, the color density, the wiping fastness, the water fastness and the water uptake capability was tested with the printed papers.

Color Density

The color density was measured with a densitometer Gretag with respect to the colors cyan, magenta, yellow, and black in incident light.

Cockle Behavior (Wavy Appearance)

For examination, the paper to be tested was placed onto a plane surface and the plane position of the paper was rated visually with the ratings 1–5 (very good to very bad).

Water Fastness

The printed papers were placed for a minute into warm water of 25° C. and dried. The color density was measured before and after water treatment. The remaining color density is provided in percent.

Drying Behavior

An image of Din A-5 format was printed onto the recording paper according to the invention. After completion of the printing process the image was lightly rubbed across the surface with a finger in 10 second intervals and was inspected with respect to smudging traces. The drying time was judged for the range=10 seconds (very good) and 20 to 30 seconds (bad).

The test results are compiled in Table 2.

TABLE 2

| | color density | | | | water fastness | | | | cockle | |
|---|---|---|---|---|---|---|---|---|---|---|
| example | cyan | magenta | yellow | black | cyan | magenta | yellow | black | ° | drying |
| 1 | 2.4 | 2.0 | 1.9 | 2.1 | 98.6 | 81.5 | 98.1 | 98.0 | 1 | <10 sec |
| 2 | 2.3 | 2.0 | 1.9 | 2.2 | 98.5 | 83.3 | 98.5 | 98.1 | 1 | <10 sec |
| 3 | 2.4 | 2.0 | 1.9 | 2.1 | 99.5 | 82.0 | 98.5 | 98.5 | 1 | <10 sec |
| C1 | 0.8 | 0.7 | 0.6 | 0.8 | — | — | — | — | 1 | <10 sec |
| C2 | 2.4 | 1.9 | 1.8 | 2.2 | 96.0 | 80.1 | 97.6 | 97.7 | 5 | <10 sec |

As can be taken from the Table, a very good cockle behavior of the recording material can be obtained together with high color density, good water fastness, and short drying times.

I claim:

1. A base paper for a recording material for the ink jet printing method, comprising 5 to 55% by weight of a filler, the paper is free of beater sizing agents and impregnated with an impregnation agent in the amount of about 2 to 25 $g/m^2$, and wherein the resin uptake from the impregnation agent is adjusted such that the base paper has a liquid uptake on the backside of at most about 20 $g/m^2$.

2. The base paper according to claim 1, wherein the liquid uptake on the backside is about 3 to 6 $g/m^2$.

3. The base paper according to claim 1, wherein the filler is titanium dioxide, zinc sulfide, calcium carbonate, kaolin, talc, clay or mixtures thereof.

4. The base paper according to claim 1 wherein the filler is a mixture of titanium dioxide and kaolin in a mixture ratio of about 1:10 to 10:1.

5. The base paper according to claim 1, wherein the impregnation agent is a resin selected from the group consisting of diallyl phthalate, epoxide resins, urea-formaldehyde resins, melamine formaldehyde resins, melamine phenol formaldehyde resins, phenol formaldehyde resins, or unsaturated polyester resins.

6. The base paper according to claim 1, wherein the impregnation agent comprises a mixture of acrylate and urea formaldehyde resin.

7. The base paper according to claim 6, wherein the mass ratio of acrylate/urea-formaldehyde is about 1:10 to 10:1.

8. A recording material for the ink jet printing method, comprising a base paper according to one of the claims 1 with at least one ink receiving layer and optionally further layers between the base paper and the ink receiving layer and on the ink receiving layer.

9. The recording material according to claim 8, wherein on the ink receiving layer a protective layer is arranged comprising a polymer with a Shore hardness of more than about 50 (DIN 53505).

* * * * *